US006003781A

United States Patent [19]

Kwan

[11] Patent Number: 6,003,781

[45] Date of Patent: Dec. 21, 1999

[54] FUEL INJECTION DEVICE WITH A LIQUID-COOLED INJECTION NOZZLE FOR A COMBUSTION CHAMBER OF A GAS TURBINE

[75] Inventor: William Kwan, Berlin, Germany

[73] Assignee: BMW Rolls-Royce GmbH, Oberursel, Germany

[21] Appl. No.: 08/966,239

[22] Filed: Nov. 7, 1997

[30] Foreign Application Priority Data

Nov. 7, 1996 [DE] Germany ..... 196 45 961

[51] Int. Cl.[6] ..... B05B 15/00

[52] U.S. Cl. ..... 239/132.3; 239/128

[58] Field of Search ..... 239/132.5, 132.3, 239/132.1, 132, 128

[56] References Cited

U.S. PATENT DOCUMENTS

| | | | |
|---|---|---|---|
| 3,043,577 | 7/1962 | Berry | 239/132.3 X |
| 3,065,916 | 11/1962 | Kurzinski | 239/132.3 |
| 3,121,457 | 2/1964 | Whipple et al. | 239/132.3 |
| 3,170,016 | 2/1965 | Grace | 239/132.3 |
| 3,198,436 | 8/1965 | Kurzinski et al. . | |
| 3,638,932 | 2/1972 | Masella et al. | 239/132.3 |
| 4,735,044 | 4/1988 | Richey et al. | 60/742 |
| 5,467,925 | 11/1995 | Riano . | |
| 5,568,721 | 10/1996 | Alary et al. | 60/746 |
| 5,577,386 | 11/1996 | Alary . | |

FOREIGN PATENT DOCUMENTS

| | | | |
|---|---|---|---|
| 0689006A1 | 12/1995 | European Pat. Off. . | |
| 0689007 | 12/1995 | European Pat. Off. . | |
| 2166395 | 8/1973 | France . | |
| 313251C2 | 10/1992 | Germany . | |
| 936901 | 12/1995 | Germany . | |
| 109091 | 8/1964 | Netherlands | 239/132.3 |
| 9408179 | 4/1994 | WIPO . | |

*Primary Examiner*—Lesley D. Morris
*Attorney, Agent, or Firm*—Pillsbury Madison & Sutro LLP

[57] ABSTRACT

A fuel injection device for a combustion chamber of a gas turbine with a liquid-cooled injection nozzle having a coolant tube which surrounds a fuel-conducting tube at a distance and which terminates in an annular chamber in the vicinity of the nozzle exit opening, or which constitutes this annular chamber which directly surrounds the fuel-conducting tube, wherein a separating wall element which surrounds the fuel-conducting tube is provided inside the coolant tube upstream of the annular chamber, viewed in the flow direction of the fuel, which divides the interior of the coolant tube into two chamber segments, wherein the first chamber segment is connected with a feed conduit and the second chamber segment with a removal conduit for the coolant.

18 Claims, 2 Drawing Sheets

FUEL INJECTION DEVICE WITH A LIQUID-COOLED INJECTION NOZZLE FOR A COMBUSTION CHAMBER OF A GAS TURBINE

FIELD OF THE INVENTION

The invention relates to a fuel injection device for a combustion chamber of a gas turbine with a liquid-cooled injection nozzle having a coolant tube which surrounds a fuel-conducting tube at a distance and which terminates in an annular chamber in for the coolant in the vicinity of the nozzle exit opening, or which constitutes this annular chamber which directly surrounds the fuel-conducting tube.

BACKGROUND OF THE INVENTION

In regard to the technical field, reference is made, besides EP 0 689 006 Al, also to WO 94/08179.

Liquid-cooled fuel injection nozzles are particularly employed in connection with staged gas turbine combustion chambers, wherein a so-called main burner is temporarily switched off. In order to prevent that the amount of fuel, which is in the injection nozzle even when it is switched off, cokes under the high temperatures which can be attained by such an injection nozzle projecting into the combustion chamber, a coolant, preferably fuel, is conducted through this injection nozzle, i.e. guided into a wall area of the injection nozzle and is retrieved again, of course without getting into the combustion chamber, by means of which an intensive cooling of the injection nozzle takes place. The two references mentioned above disclose such fuel injection devices with such liquid-cooled injection nozzles, but these fuel injection devices are relatively complicated in their structure.

OBJECT AND SUMMARY OF THE INVENTION

It is the object of the instant invention to disclose a relatively simple but functionally dependable fuel injection device for a combustion chamber of a gas turbine, which is advantageous in respect to the flow conditions of the coolant.

The attainment of this object is distinguished in that a separating wall element, which surrounds the fuel-conducting tube, is provided inside the coolant tube upstream of the annular chamber, viewed in the flow direction of the fuel, which divides the interior of the coolant tube into two chamber segments, wherein the first chamber segment is connected with a feed conduit and the second chamber segment with a removal conduit for the coolant.

The invention will be explained in more detail by means of a preferred exemplary embodiment.

DETAILED DESCRIPTION OF THE PREFERRED EMBODIMENT

Figure 1:
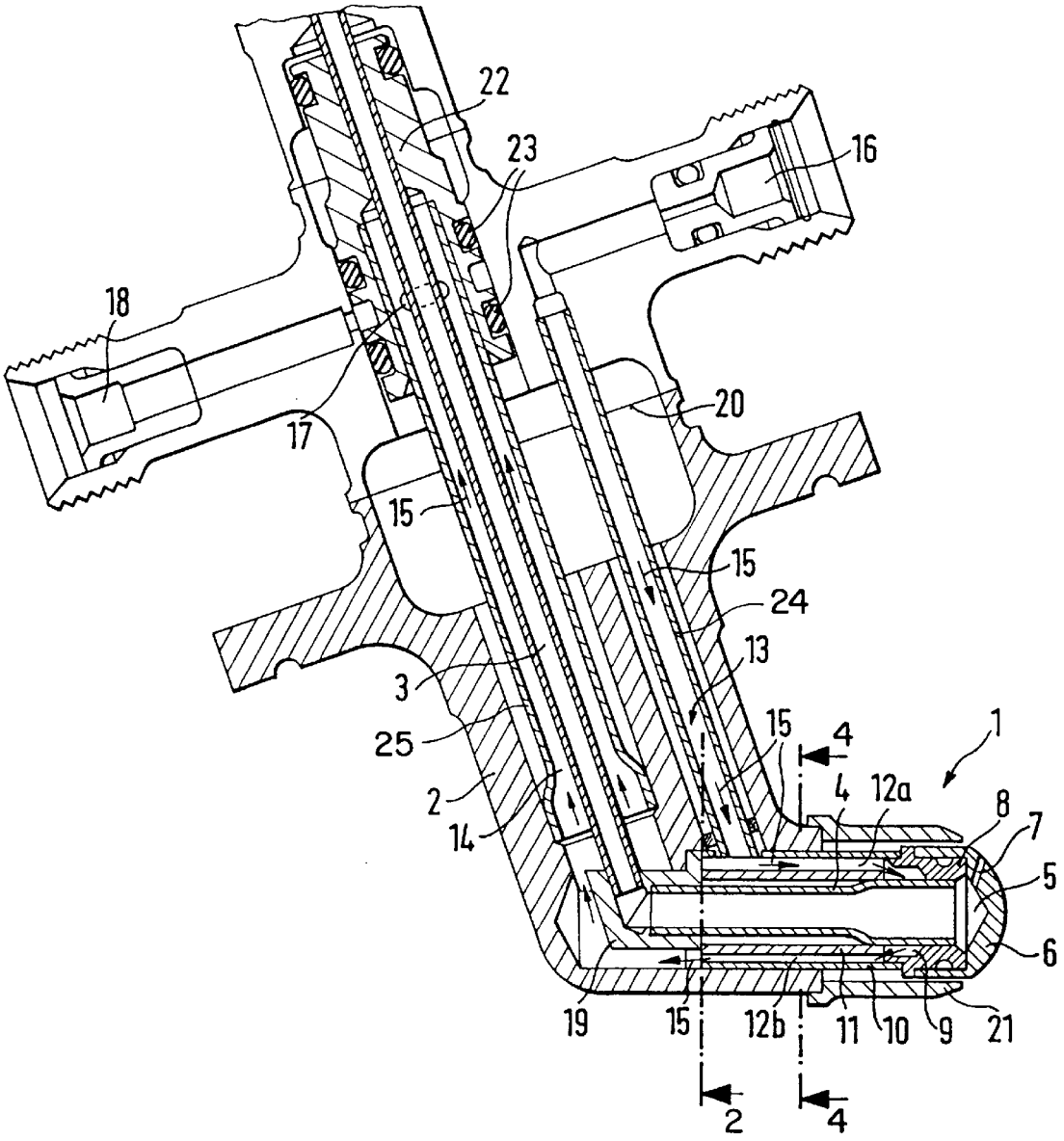
FIG. 1 represents a section through a fuel injection device in accordance with the invention.
Figure 2:
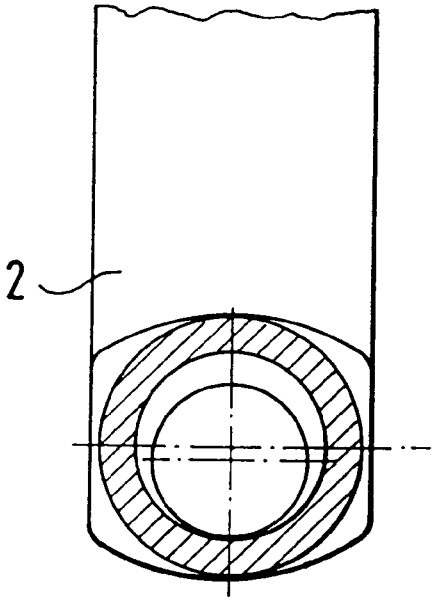
FIG. 2 shows the view 2 on the so-called nozzle support.
Figure 3:
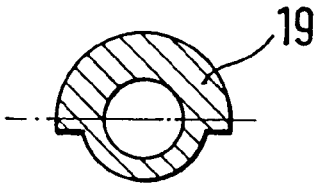
FIG. 3 the view 2 on the elbow element to be explained later.

The fuel injection device represented projects with the totality of its injection nozzle, which as a whole is identified by 1, into the combustion chamber, not shown, of a gas turbine. As is customary, the injection nozzle 1 is fixed on a so-called nozzle support 2 of the fuel injection device. A fuel feed line 3, which makes a transition into a fuel-conducting tube 4 provided in the injection nozzle 1, extends inside this nozzle support 2. The fuel-conducting tube terminates in a hollow chamber 5 inside the nozzle tip element 6, which has at least one nozzle outlet opening 7, through which the fuel which is supplied via the feed line 3 as well as the fuel conducting tube 4 can reach the combustion chamber of the gas turbine. As is customary, an end cap 8, in which the fuel-conducting tube 4 is seated, is provided inside the nozzle tip element 6.

The nozzle tip element 6 as well as the end cap 8 in particular, or the area thereof are to be cooled in order to prevent that fuel standing in this area in the fuel conducting tube 4 cokes. Because of the high temperatures in the interior of a gas turbine combustion chamber, particularly the area of an injection nozzle 1 located near the nozzle outlet opening 7 attains such high temperatures, that fuel located in the injection nozzle 1 and which had not been conveyed on would inevitably coke.

For cooling the said area, coolant is conducted through the injection nozzle 1, namely through an annular chamber 9, among others, which is bordered, among others, by the end cap 8 and the exterior of the fuel-conducting tube 4. Coolant is conducted through this annular chamber 9, namely in accordance with the arrows which are provided with the reference numeral 15 at another location, and wherein preferably fuel is again employed as the coolant.

Figure 4:
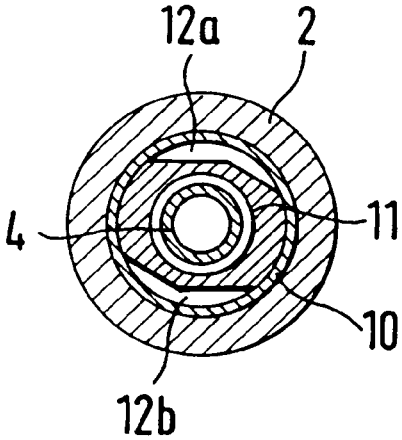
FIG. 4 shows the section 4—4 from FIG. 1.

A coolant tube 10 is provided both for feeding of coolant as well as its removal from the annular chamber 9, which encloses the fuel-conducting tube 4 at a distance. In this case the annular chamber between the coolant tube 10 and the fuel-conducting tube 4 is divided into two chamber segments 12*a*, 12*b* by means of a so-called separating wall element 11, as can be seen in FIG. 4 in particular. In this case coolant can be conducted via the upper chamber segment 12*a* into the annular chamber 9 and can be removed again via the lower chamber segment 12*b*. To this end, respectively the upper chamber segment 12*a* is connected with a feed conduit 13, and the lower chamber segment 12*b* with a removal conduit 14. In this case the coolant flow is represented by arrows 15.

Both the feed conduit 13 and the removal conduit 14 of course extend also inside the nozzle support 2 and are embodied inside it essentially as coolant lines, which have been provided with reference numerals 24 and 25. The first coolant line 24, which essentially is connected with a feed flange 16 provided on the nozzle support 2, terminates directly in the upper chamber segment 12*a* in the form of a tube element. The second coolant line 25 also encloses the fuel feed line 3 at a distance and is arranged essentially concentric in respect to it. This second coolant line 25 is connected via an outlet opening 17 with a removal flange 18 for coolant, provided on the nozzle support 2. This coolant line 25 terminates with its other end provided directly on the nozzle support 2, and it is connected with the lower chamber segment 12*b*, bypassing a so-called elbow element 19.

The just mentioned elbow element 19 is used, on the one hand, for receiving the end of the fuel-conducting tube 4 remote from the end cap 8 and, since it is made hollow, it simultaneously connects this fuel-conducting tube 4 with the fuel feed line 3. The elbow element 19 itself is seated on or pressed into the nozzle support 2 as indicated.

Because of the elements mentioned, the fuel injection device represented is distinguished by a particularly simple structure. Both the coolant lines 13 and 14 and the fuel feed line 3 can be simply inserted into the appropriately shaped nozzle support 2, which can be embodied to be divided in the area of the level 20. The elbow element 19 can be inserted just as easily and in the process guides the lower end of the coolant line 14. Thereafter the fuel-conducting tube 4 can be plugged into this elbow element 19, after which the separating wall element 11 and the coolant tube 10 are inserted. Finally, only the end cap 8 with the nozzle tip element 6 and a shielding cap 21 must be mounted. Optimal guidance of the coolant is possible in spite of this simple structure, wherein an optimal coolant flow with advantageous heat removal occurs because of the feeding of the coolant into the annular chamber 9 only in its upper area and the removal thereof only in the lower area of the annular chamber 9. The coolant flow can of course also be opposite the arrow direction 15.

The chamber segments 12*a*, 12*b* here take on the shape of segments of a cylinder after the fuel-conducting tube 4 extends in a straight line. This also results in a particularly simple shape of the separating wall element 11, wherein by means of a suitable selection of its cross-sectional surface it is also possible to preselect the respectively most advantageous volume or the respectively most advantageous contour of the chamber segments 12*a*, 12*b*. A seal support 22, which is provided with annular seals 23, is furthermore provided in the upper area of the nozzle support 2, in particular to prevent an undesirable flow-off of coolant in an area on the side of the removal flange 18.

If fuel is employed as coolant, it is furthermore possible to feed the discharged coolant or the discharged fuel via this discharge flange 18 to a further injection nozzle for a continuously operated pilot burner of the gas turbine combustion chamber. However, it is also possible to conduct the fuel back into the tank. Besides this, it is of course possible to design a multitude of details, in particular of a constructive type, in a way differing from the represented exemplary embodiment without departing from the contents of the claims. Thus, it is not necessary that the nozzle exit opening 7, or several of these, be arranged in a ring shape, nor need they be designed as shown here, instead it is possible to create a conically shaped single fuel stream by means of a single exit opening 7.

What is claimed:

1. A fuel injection device for a combustion chamber of a gas turbine, comprising:

a liquid-cooled injection nozzle, including:

a nozzle exit opening;

an annular chamber positioned proximal to the nozzle exit opening;

a fuel-conducting tube connected to the nozzle exit opening;

a coolant feed conduit;

a coolant removal conduit;

a coolant tube surrounding a length of the fuel-conducting tube, the coolant tube including a first chamber and a second chamber, the first chamber connecting the coolant feed conduit and the annular chamber, the second chamber connecting the coolant removal conduit and the annular chamber;

a separating wall positioned within the coolant tube and connected to the fuel-conducting tube to separate the first chamber from the second chamber, the separating wall positioned downstream from the coolant feed conduit and upstream from the coolant removal conduit.

2. The fuel injection device of claim 1, and further comprising:

a nozzle support, including a fuel feed line;

an elbow joint connecting the fuel-conducting tube and the fuel feed line, wherein the coolant tube is seated directly in the nozzle support and the coolant feed conduit is positioned in the nozzle support.

3. The fuel injection device of claim 2, wherein the coolant removal conduit includes a second coolant line provided in the nozzle support, the second coolant line surrounding the fuel feed line.

4. The fuel injection device of claim 3, wherein the nozzle support further includes a coolant feed flange connected to the coolant feed conduit and a coolant removal flange connected to the coolant removal conduit.

5. The fuel injection device of claim 4, wherein the injection nozzle further includes a nozzle tip element in which the nozzle exit opening is positioned, an end cap positioned in the nozzle tip element, the end cap bordering the annular chamber.

6. The fuel injection device of claim 2, wherein the nozzle support further includes a coolant feed flange connected to the coolant feed conduit and a coolant removal flange connected to the coolant removal conduit.

7. The fuel injection device of claim 6, wherein the injection nozzle further includes a nozzle tip element in which the nozzle exit opening is positioned, an end cap positioned in the nozzle tip element, the end cap bordering the annular chamber.

8. The fuel injection device of claim 1, wherein the injection nozzle further includes a nozzle tip element in which the nozzle exit opening is positioned, an end cap positioned in the nozzle tip element, the end cap bordering the annular chamber.

9. The fuel injection device of claim 2, wherein the injection nozzle further includes a nozzle tip element in which the nozzle exit opening is positioned, an end cap positioned in the nozzle tip element, the end cap bordering the annular chamber.

10. A fuel injection device for a combustion chamber of a gas turbine, comprising:

a liquid-cooled injection nozzle, including:

a nozzle exit opening;

an annular chamber positioned proximal to the nozzle exit opening;

a fuel-conducting tube connected to the nozzle exit opening;

a coolant feed conduit;

a coolant removal conduit;

a coolant tube surrounding a length of the fuel-conducting tube, the coolant tube including a first chamber and a second chamber, the first chamber connecting the coolant feed conduit and the annular chamber, the second chamber connecting the coolant removal conduit and the annular chamber;

a separating wall positioned within the coolant tube and connected to the fuel-conducting tube to separate the first chamber from the second chamber, the separating wall positioned proximal the nozzle exit opening.

11. The fuel injection device of claim 10, and further comprising:

a nozzle support, including a fuel feed line;

an elbow joint connecting the fuel-conducting tube and the fuel feed line, wherein the coolant tube is seated directly in the nozzle support and the coolant feed conduit is positioned in the nozzle support.

12. The fuel injection device of claim 11, wherein the coolant removal conduit includes a second coolant line provided in the nozzle support, the second coolant line surrounding the fuel feed line.

13. The fuel injection device of claim 12, wherein the nozzle support further includes a coolant feed flange connected to the coolant feed conduit and a coolant removal flange connected to the coolant removal conduit.

14. The fuel injection device of claim 13, wherein the injection nozzle further includes a nozzle tip element in which the nozzle exit opening is positioned, an end cap positioned in the nozzle tip element, the end cap bordering the annular chamber.

15. The fuel injection device of claim 11, wherein the nozzle support further includes a coolant feed flange connected to the coolant feed conduit and a coolant removal flange connected to the coolant removal conduit.

16. The fuel injection device of claim 15, wherein the injection nozzle further includes a nozzle tip element in which the nozzle exit opening is positioned, an end cap positioned in the nozzle tip element, the end cap bordering the annular chamber.

17. The fuel injection device of claim 10, wherein the injection nozzle further includes a nozzle tip element in which the nozzle exit opening is positioned, an end cap positioned in the nozzle tip element, the end cap bordering the annular chamber.

18. The fuel injection device of claim 11, wherein the injection nozzle further includes a nozzle tip element in which the nozzle exit opening is positioned, an end cap positioned in the nozzle tip element, the end cap bordering the annular chamber.

* * * * *